US009402123B1

(12) United States Patent
Sumsion

(10) Patent No.: US 9,402,123 B1
(45) Date of Patent: Jul. 26, 2016

(54) IN-LINE CORD MANAGEMENT AND CLIP SYSTEM

(71) Applicant: ZAGG Intellectual Property Holding Co., Inc., Salt Lake City, UT (US)

(72) Inventor: Cecily Sumsion, Draper, UT (US)

(73) Assignee: ZAGG Intellectual Property Holding Co., Inc., Midvale, UT (US)

( * ) Notice: Subject to any disclaimer, the term of this patent is extended or adjusted under 35 U.S.C. 154(b) by 0 days.

(21) Appl. No.: 14/812,761

(22) Filed: Jul. 29, 2015

Related U.S. Application Data

(60) Provisional application No. 62/031,464, filed on Jul. 31, 2014.

(51) Int. Cl.
*H04R 25/00* (2006.01)
*H04R 1/10* (2006.01)

(52) U.S. Cl.
CPC ..... *H04R 1/1033* (2013.01)

(58) Field of Classification Search
CPC ..... H04R 1/1033; H04R 1/10; H04R 1/1016; H04R 2460/17; A44B 99/00
USPC ..... 381/381, 380, 370, 374, 182, 386, 379; 24/302–306, 16 PB; 224/666; D8/356
See application file for complete search history.

(56) References Cited

U.S. PATENT DOCUMENTS

| | | | | |
|---|---|---|---|---|
| 8,261,416 | B2 | 9/2012 | Rothbaum et al. | |
| D675,505 | S | 2/2013 | Rothbaum et al. | |
| D746,663 | S * | 1/2016 | Rothbaum | D8/356 |
| D750,956 | S * | 3/2016 | Rothbaum | D8/356 |
| 2007/0086617 | A1 | 4/2007 | Loh | |
| 2011/0252606 | A1 | 10/2011 | Rothbaum et al. | |
| 2015/0121659 | A1 | 5/2015 | Bacino | |
| 2015/0223573 | A1 * | 8/2015 | Vecchione | A44B 99/00 24/16 PB |
| 2016/0080851 | A1 * | 3/2016 | Sumsion | H04R 1/1033 381/74 |

OTHER PUBLICATIONS

Klinggon; Magnetic Earphone Cord Holder; Accessed Jun. 3, 2015; 1 page; http://www.klingg.com/.
O!Snap; The O!Snap Headphone Holder; Accessed Jun. 3, 2015; 5 pages; https://osnapclip.com/osnap-headphone-holder.
MaCo; Magnetic Cable Organiser; Accessed Jun. 3, 2015; 13 pages; https://www.shopstarter.com/p/492876551/macro-magnetic-cable-organiser.
Magneat; Magneat Cord Manager; Accessed Jun. 3, 2015; 5 pages; https://www.koyono.com/Magneat-Cord-Manager.

* cited by examiner

*Primary Examiner* — Davetta W Goins
*Assistant Examiner* — Phylesha Dabney
(74) *Attorney, Agent, or Firm* — Thorpe, North & Western, LLP

(57) ABSTRACT

A cord management system comprises a collar with a bore enclosing a portion of the cord. A flexible band extends from a proximal end at the collar to a distal free end. A free ferromagnetic button is embedded in the distal free end of the band. A fixed ferromagnetic button is embedded in the collar. The band forms a ring with the free ferromagnetic button of the distal free end of the band magnetically coupled to the fixed ferromagnetic button of the collar for enclosing and securing a portion of a loop or a bundle formed by the cord. The proximal end of the band can extend from one side of the collar, and the fixed ferromagnetic button can be disposed in the collar on another side of the collar opposite the proximal end of the band.

23 Claims, 9 Drawing Sheets

IN-LINE CORD MANAGEMENT AND CLIP SYSTEM

PRIORITY CLAIM

Priority is claimed to U.S. Provisional Patent Application Ser. No. 62/031,464, filed Jul. 31, 2014, which is hereby incorporated herein by reference in its entirety.

BACKGROUND

1. Field of the Invention

The present invention relates generally to a cord management system for any type of cord, including for example earphone, earbuds, headphones, and the like.

2. Related Art

Earphones are a common accessory to many portable media players, such as cellular phones, tablets or tablet computers, and digital music players. Such earphones typically have a pair of cords or wires running from a headphone plug that plugs into a headphone jack, to a pair of earphones inserted in the ears of a user, or disposed on the ears of a user. The pair or cords or wires is commonly conjoined for a majority of the length, and splits at a junction into separate cords or wires for each of the earphones. Such wires are often capable of becoming tangled and knotted.

Similarly, other types of cords can similarly become tangled and knotted.

SUMMARY OF THE INVENTION

It has been recognized that it would be advantageous to develop a system and method to manage cords or wires. In addition, it has been recognized that it would be advantageous to develop a system and method to manage cords or wires associated with earphones and the like.

The invention provides a cord management system in combination with an audio cord. The audio cord comprises an audio plug, a pair of conjoined wires extending from the audio plug and separating at a junction into a pair of separate audio wires terminating at a pair of earbuds. The system comprises a sleeve circumscribing the junction of the audio cord. A flexible band extends from a proximal end at the sleeve to a distal free end. The flexible band has a collar at the proximal end with a bore therethrough receiving the sleeve and the junction. A free ferromagnetic button is embedded in the distal free end of the band. A fixed ferromagnetic button is embedded in the collar at the proximal end of the band. The band forms a ring with the free ferromagnetic button of the distal free end of the band magnetically coupled to the fixed ferromagnetic button of the collar for enclosing and securing a portion of a loop or a bundle formed by the audio cord. The system and the audio cord have a plurality of configurations, including: 1) a use configuration, with the audio cord extending a longer length, and with the ring free of the audio cord or with the ring having a lesser number of passes of the audio cord extending through the ring; 2) a loop storage configuration, with the audio cord extending a shorter length than the longer length, and wrapped into a loop with a greater number of passes of the audio cord extending though the ring than the lesser number of passes, and with the audio cord looping through and around the ring; 3) a bundle storage configuration, with the audio cord extending a shorter length than the longer length, and wrapped into a bundle with a greater number of passes of the audio cord extending through the ring than the lesser number of passes, and with the audio cord extending back and forth through the ring; 4) a clip configuration, with an article of clothing with the free ferromagnetic button of the distal free end of the band magnetically coupling to the fixed ferromagnetic button of the collar with the article of clothing therebetween; and 5) a single earbud configuration with a ferromagnetic element of one earbud of the pair of earbuds magnetically coupled to the fixed ferromagnetic button of the collar, or the free ferromagnetic button of the distal free end, or both. The proximal end of the band extends from one side of the collar, and the fixed ferromagnetic button is disposed in the collar on another side of the collar opposite the proximal end of the band.

In addition, the invention provides a splitter device for an audio cord. The device comprises a collar configured to be disposed at a junction of the audio cord with a pair of conjoined wires extending from an audio plug and separating at the collar into a pair of separate audio wires terminating in earbuds. A band extends from a proximal end at the collar to a distal free end. A free ferromagnetic button embedded in the distal free end of the band. A fixed ferromagnetic button embedded in the collar. The band forms a ring with the free ferromagnetic button of the distal free end of the band magnetically coupled to the fixed ferromagnetic button of the collar for enclosing and securing a portion of a loop or a bundle formed by the audio cord. The proximal end of the band extends from one side of the collar, and the fixed ferromagnetic button is disposed in the collar on another side of the collar opposite the proximal end of the band.

Furthermore, the invention provides a cord management system in combination with a cord. The system comprises a collar with a bore enclosing a portion of the cord. A flexible band extends from a proximal end at the collar to a distal free end. A free ferromagnetic button is embedded in the distal free end of the band. A fixed ferromagnetic button is embedded in the collar. The band forms a ring with the free ferromagnetic button of the distal free end of the band magnetically coupled to the fixed ferromagnetic button of the collar for enclosing and securing a portion of a loop or a bundle formed by the cord.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

FIG. 11*b* showing wrapping a flexible band around a portion of the loop by extending a distal free end through the loop and back towards a proximal end extending from a collar enclosing a portion of the audio cord at the junction; and FIG. 11*c* showing coupling the distal free end to the collar by magnetically coupling a free ferromagnetic button embedded in the distal free end of the band to a fixed ferromagnetic button embedded in the collar forming a ring enclosing and securing the portion of the loop, defining the loop storage configuration;

FIG. 12*b* showing wrapping a flexible band around a portion of the bundle by extending a distal free end around the bundle and back towards a proximal end extending from a collar enclosing a portion of the audio cord at the junction; and FIG. 12*c* showing coupling the distal free end to the collar by magnetically coupling a free ferromagnetic button embedded in the distal free end of the band to a fixed ferromagnetic button embedded in the collar forming a ring enclosing and securing the portion of the bundle, defining the bundle storage configuration;

Figure 1A:
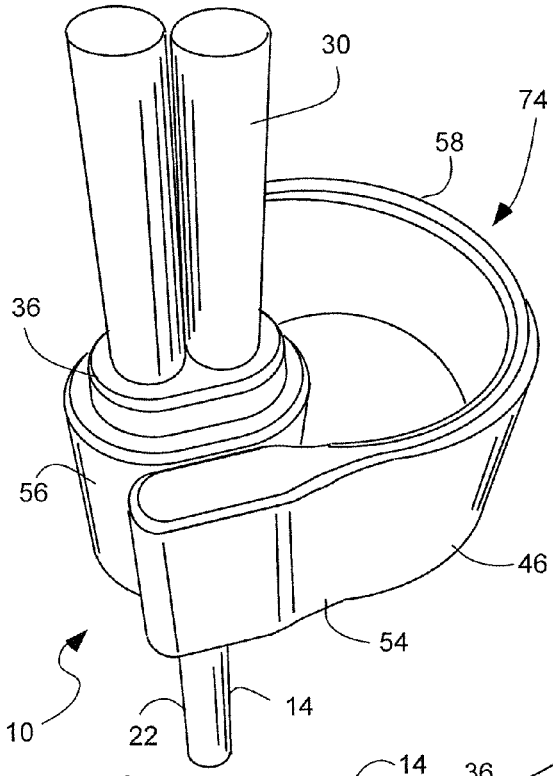
FIG. 1*a* is a perspective view of a cord management system in combination with a cord (such as an audio cord comprising an audio plug, a pair of conjoined wires extending from the audio plug and separating at a junction into a pair of earbuds) in accordance with an embodiment of the present invention, shown in a free or use or listening configuration, and with the band shown in a closed configuration.
Figure 1B:
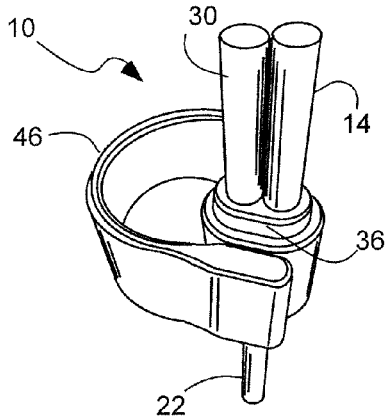
FIG. 1*b* is a perspective view of the cord management system of FIG. 1*a*, shown in a use configuration, and with the band shown in the closed configuration.
Figure 2:
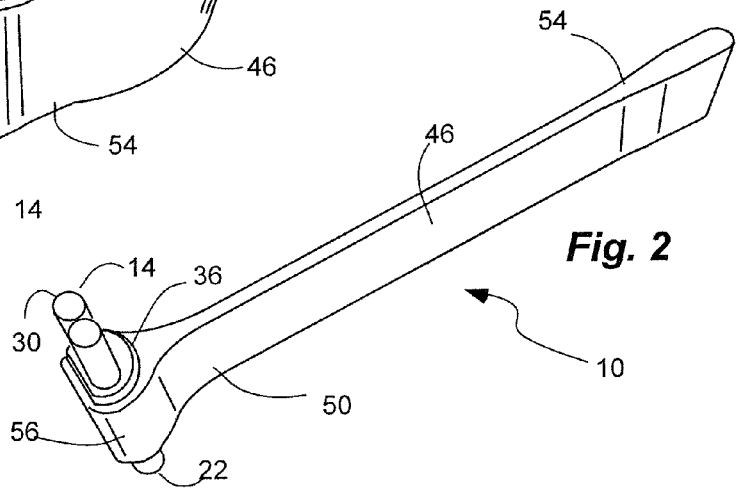
FIG. 2 is a perspective view of the cord management system of FIG. 1*a*, with the band shown in the open configuration.
Figure 3:
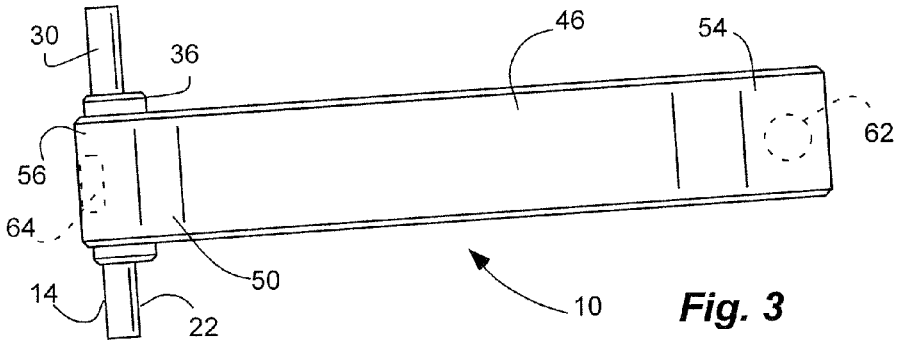
FIG. 3 is a side view of the cord management system of FIG. 1*a*, with the band shown in the open configuration.
Figure 4:
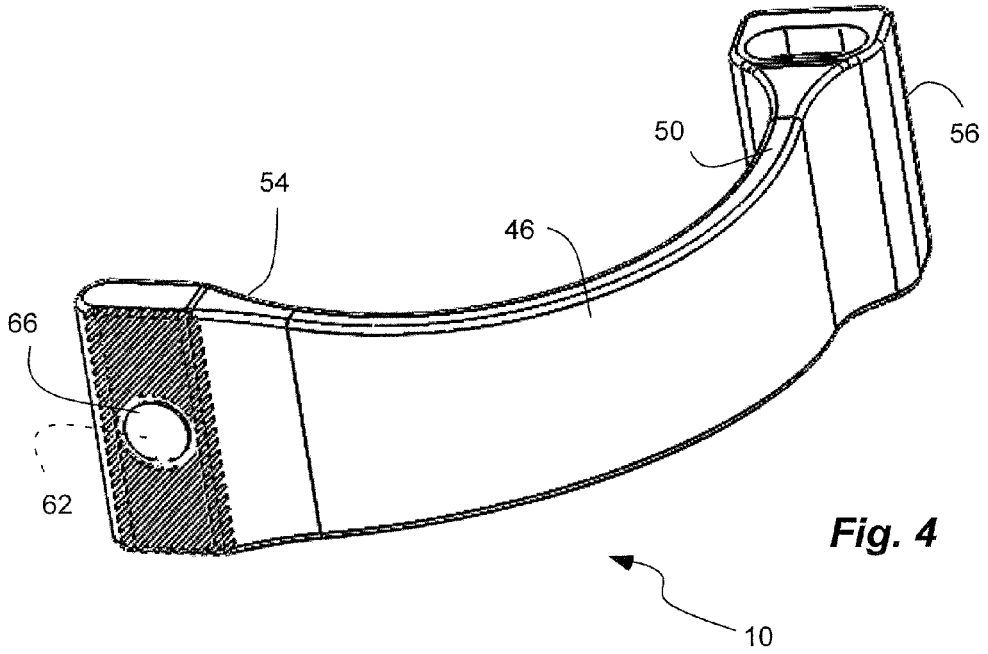
FIG. 4 is a perspective view of a flexible band of the cord management system of FIG. 1*a*, shown in an open configuration.
Figure 5:
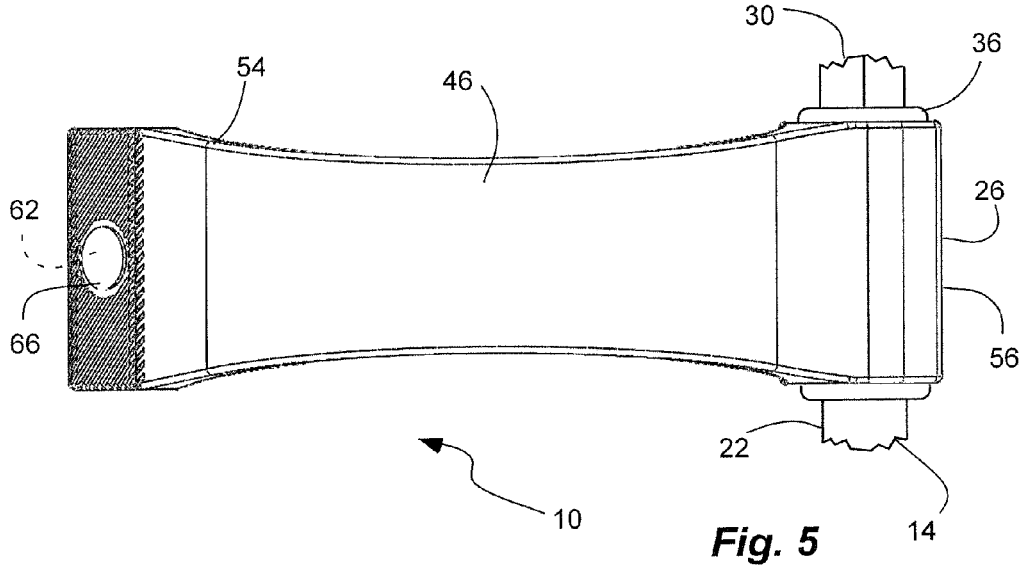
FIG. 5 is a side view of the flexible band of the cord management system of FIG. 1*a*, shown in the open configuration.
Figure 6:
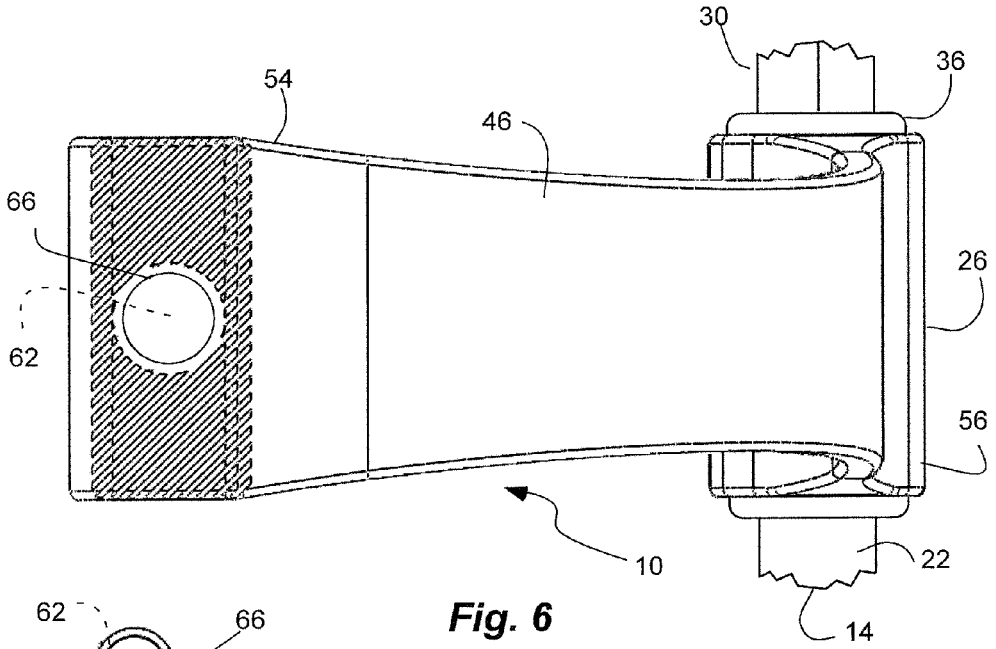
FIG. 6 is a side view of the flexible band of the cord management system of FIG. 1*a*, shown in the open configuration.
Figure 7:
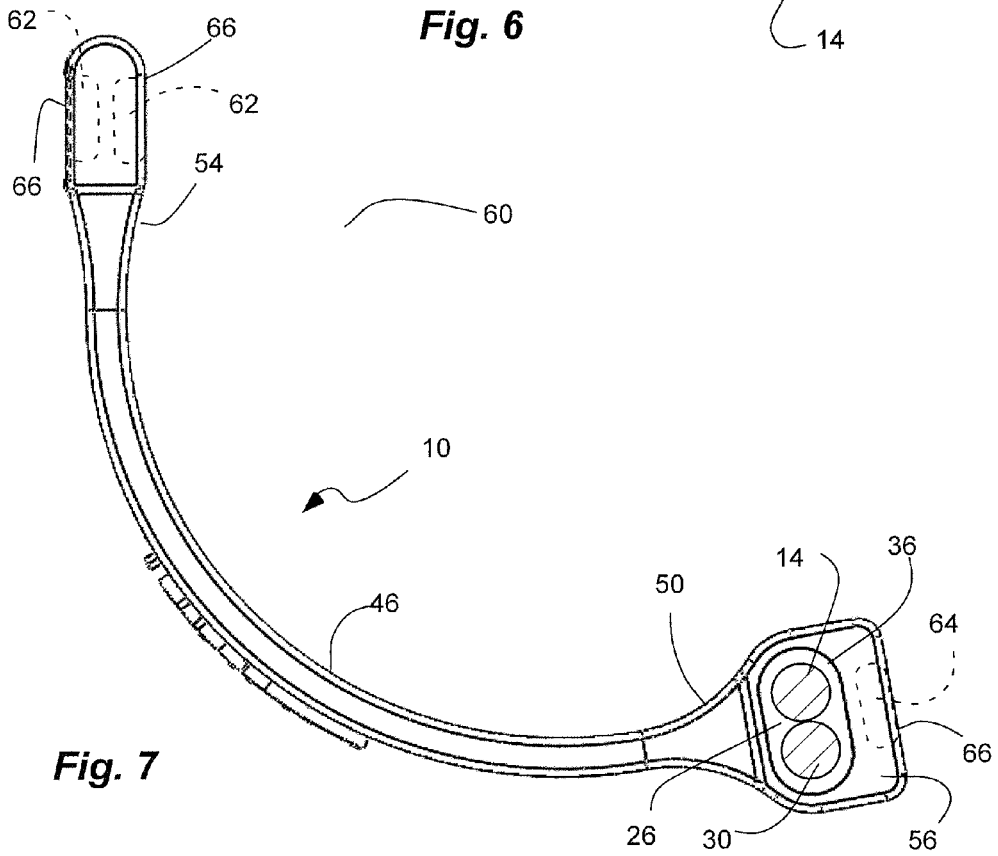
FIG. 7 is a top view of the flexible band of the cord management system of FIG. 1*a*, shown in the open configuration.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "ferromagnetic" is used herein to refer to a material or element that has magnetic properties and/or an ability to magnetically couple, either by being magnetic, or being magnetically attracted to a magnet (such as by containing iron) such that one ferromagnetic material or element is magnetically attracted to another ferromagnetic material or element. Thus, a ferromagnetic button is a magnet or is magnetic, such as a permanent magnet, or is attracted to magnets, such as by containing iron.

DESCRIPTION

As illustrated in FIGS. 1-14*b*, a cord management system, indicated generally at 10, and methods for managing a cord, such as an audio cord, indicated generally at 14, in an example implementation in accordance with the invention are shown. In one aspect, the cord management system 10 can be part of an audio cord 14 comprising an audio plug 18 (FIGS. 8-10), a pair of conjoined wires 22 extending from the audio plug and separating at a junction 26 into a pair of separate audio wires 30 terminating at earbuds 34 (or 34*a* and 34*b*). In another aspect, the cord management system can be part of an audio cord similar to that described above, but with the audio cord extending as a single wire, or pair of conjoined wires, to a first earbud, and wire extending from the first earbud to a second earbud. Thus, the conjoined wires can split at the first earbud. The cord management system 10 can be used to manage the cord 14, and can resist tangling of the cord.

The cord management system can comprise a sleeve 36 carried by the cord, such as the audio cord 14, and circumscribing the junction 26 of the audio cord. In one aspect, the collar can be fixed to the cord. In another aspect, the collar can be slidably disposed on the cord. In another aspect, the collar can be removably coupled or clipped to the cord. The sleeve 36 can be rigid and can have a bore therethrough for receiving the audio cord 14. The sleeve can circumscribe the junction 26 to resist separation of the conjoined wires 22 when a user pulls on the separate audio wires 30.

The cord management system 10 can comprise a splitter 38 for the audio cord 14 disposed at the junction 26. The splitter 38 can have the sleeve 36 disposed at the junction 26 of the audio cord 14 with the pair of conjoined wires 22 extending from the audio plug 18 and separating at the sleeve 36 into the pair of separate audio wires 30 terminating in the earbuds 34. The sleeve 26 can define the splitter 38. Thus, the splitter 38 and/or the sleeve 36 can have a hollow or bore therethrough through which the audio cord 14 extends, and can have a single opening in one end for the pair of conjoined wires 22, and a pair of openings in the other end for the pair of separate audio wires 30. The sleeve 36 can enclose a portion of the audio cord at the junction. Thus, the splitter and/or the sleeve are joined to or attached to the audio cord. In one aspect, the sleeve can be fixed to the cord. In another aspect, the sleeve and/or the splitter can be electrically coupled to the audio cord, and can comprise a microphone and/or volume control buttons. In another aspect, the sleeve can be slidably attached to the cord. In another aspect, the sleeve can be removably coupled or clipped to the cord, and can be removed and used with other cords.

The cord management system 10 can comprise a flexible band 46 that can extend from a proximal end 50 at the sleeve or junction to a distal free end 54. The flexible band 46 can have a collar 56 at the proximal end with a bore therethrough receiving the sleeve and the junction. The collar 56 and the band 46 can be integrally formed at the same time and of the same material. In one aspect, the material can be a flexible material, such as a rubber or silicone material. The band 46 can be flexible and bendable. The band 46 can be flexible to form a ring 58 (FIG. 1*a*) with the distal free end folded back against the collar 56 or the proximal end 50. The band can be flexible the bend outwardly from the collar to form an opening 60 (FIG. 7) to the ring.

In another aspect, the material can be a flexible and resilient material, such as a plastic or other elastomer. The material can be elastic. In one aspect, the band can be initially formed in a closed configuration or ring configuration with the distal free end of the band proximal the collar. Thus, the band can form the ring and can be biased (or have an initial unstressed at rest configuration) into the closed configuration and into the ring by the resiliency of the material. The band can have an open configuration where the distal free end of the band is separated from the collar, and the band is under stress or forms a spring element moved to the open configuration by the application of an applied force. In another aspect, the band can have the opposite configuration, i.e. the band can be initially formed in the open configuration so that the band can be biased (or have an initial unstressed at rest configuration) into the open configuration. The band can have a closed configuration with the band under stress and held by the ferromagnetic buttons in the closed configuration. In another aspect, the band can be initially formed in an open configuration in an arc or straight line so that the band can be biased open, and can be held closed by the magnets. Thus, the band can snap open when the ferromagnetic buttons are released.

The collar and the band can have a height along the cord to facilitate grasping with a user's fingers. In one aspect, the band can wrap multiple times or rotations to form the ring. In another aspect, the band can wrap less than one full rotation. In one aspect, the distal free end 54 of the band 46 can be enlarged with an enlarged cross-section with respect to an intermediate portion of the band 46 between the distal free end 54 and the proximal end 50. In one aspect, the distal free end 54 can be thicker than the intermediate portion. In another aspect, the distal free end 54 can be higher or taller than the intermediate end. The enlarged distal free end can facilitate grasping and manipulation during use, and can direct bending and flexing to the intermediate portion of the band.

A free ferromagnetic button 62 can be embedded in the distal free end 54 of the band 46; while a fixed ferromagnetic button 64 (FIG. 7) can be embedded in the collar 56 or proximal end 50. In one aspect, the buttons 62 and 64 can be completely embedded within the material of the collar 56 or the band 46. The band 46 and/or the collar 56 can include indicia 66 to indicate the location of the buttons 62 and 64, and thus an attachment location or point. In another aspect, the buttons can be partially embedded, and can have a portion thereof exposed through the band and/or the collar. The term "ferromagnetic" is used herein to refer to a material or element that has magnetic properties and/or an ability to magnetically couple, either by being magnetic, or being magnetically attracted to a magnet (such as by containing iron) such that one ferromagnetic material or element is magnetically attracted to another ferromagnetic material or element. Thus, a ferromagnetic button is a magnet or is magnetic, such as a permanent magnet, or is attracted to magnets, such as by containing iron. In one aspect, both of the buttons can be magnets (and thus both buttons are ferromagnetic). In another aspect, one of the buttons can be a magnet, while the other button contains iron (and thus both buttons are ferromagnetic).

In one aspect, the free distal end 54 of the band 46 can have a single ferromagnetic button 62, such as a button containing iron, while the fixed ferromagnetic button 64 can be a magnet. Thus, the band can be wrapped around an axis of the cord 14, the collar 56, and/or the sleeve 42 in either direction. In another aspect, the free distal end 54 of the band 46 can have a pair of free ferromagnetic buttons 62, one on each side thereof, that can be magnets, while the fixed ferromagnetic button 64 can be a button containing iron. Thus, the band can be wrapped around an axis of the cord 14, the collar 56, and/or the sleeve 42 in either direction. Thus, the system or band can be multi-directional, or bi-directional. The bi-direction forming of the ring can allow the cord management system to be used with right or left button down shirts, etc., as described in greater detail below.

In one aspect, the proximal end 50 of the band 46 can extend from one side of the collar 56, and the fixed ferromagnetic button 64 can disposed in the collar 56 on another side of the collar opposite the proximal end of the band. Thus, the collar 56 is disposed between the ends 50 and 54 of the band 46 when closed, and the collar 56 forms a portion of the ring 58 along with the collar. Having the fixed ferromagnetic button 64 and the proximal end 50 of the band 54 on opposite sides of the collar 56 can help form and define the ring 58. The ring can define a space to receive the audio cord, and/or an article of clothing, as described below.

In one aspect, the distal free end 54 of the band 46 can have a flat surface, and the another side of the collar 56 opposite the proximal end 50 of the band 46 can have a flat surface to which the flat surface of the distal free 54 end of the band 46 abuts in the closed configuration forming the loop 58. The flat surfaces can maximize the magnetic grip between the ferromagnetic buttons 62 and 64.

The band 46 can form a ring 58 with the free ferromagnetic button 62 of the distal free end 54 of the band 46 magnetically coupled to the fixed ferromagnetic button 64 of the collar 56 for enclosing and securing a portion of a loop 68 (FIG. 10) or a bundle 70 (FIG. 9) formed by the audio cord 14 or portion thereof.

Figure 8:
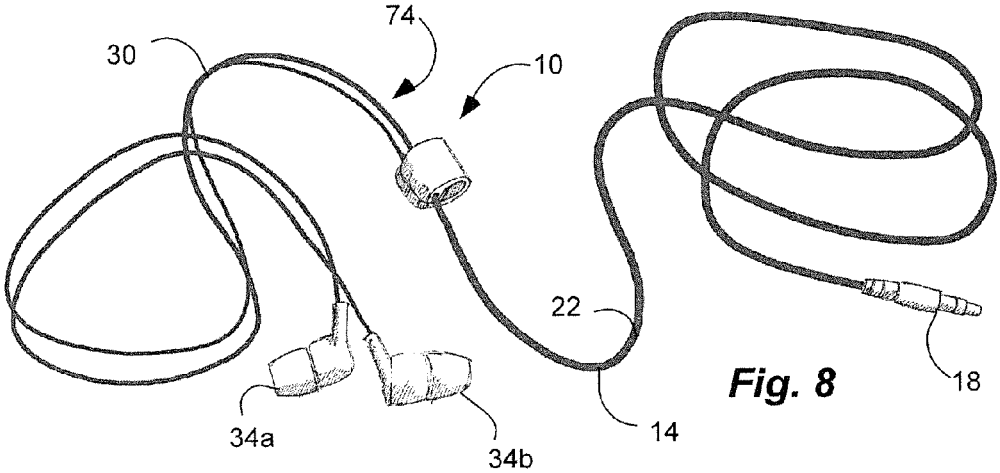
FIG. 8 is a perspective view of the cord management system of FIG. 5*a*, shown in a use configuration with an audio cord extending a longer length, and with a ring formed by the band in the closed configuration free of the audio cord or with the ring having a lesser number of passes of the audio cord extending through the ring.
Figure 9:
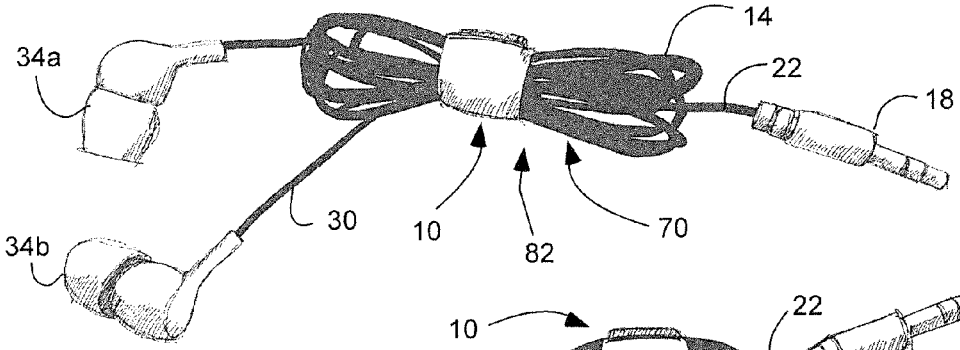
FIG. 9 is a perspective view of the cord management system of FIG. 5*a*, shown in a bundle storage configuration with the audio cord extending a shorter length than the longer length and wrapped into a bundle with a greater number of passes of the audio cord extending through the ring than the lesser number of passes, and with the audio cord extending back and forth through the ring.
Figure 11C:
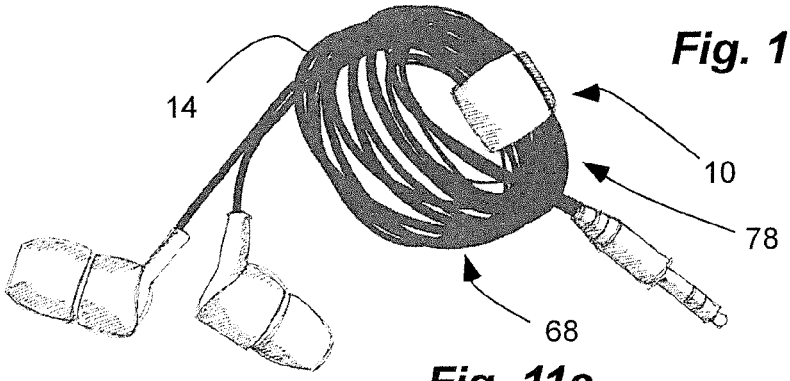
Figure 12A:
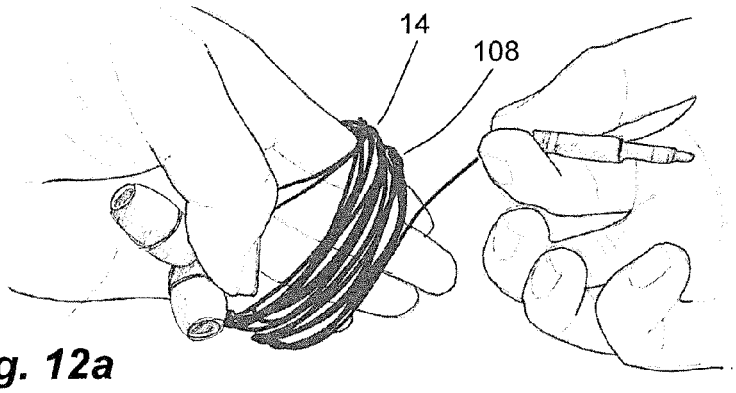
FIGS. 12*a-c* are perspective views of a method for managing an audio cord comprising an audio plug, a pair of conjoined wires extending from the audio plug and separating at a junction into a pair of wires terminating in earbuds in accordance with the present invention; with FIG. 12*a* showing forming the audio cord into a bundle.
Figure 12B:
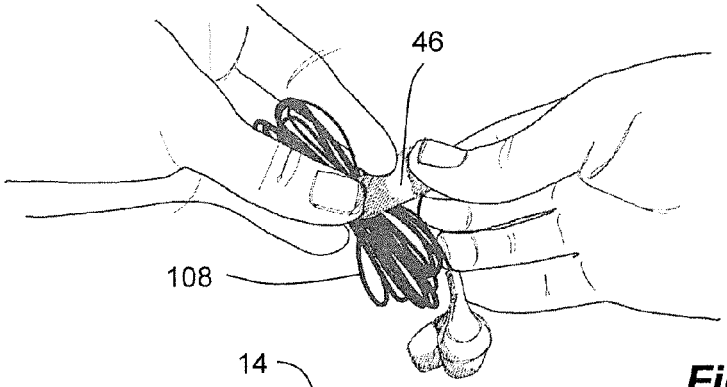
Figure 12C:
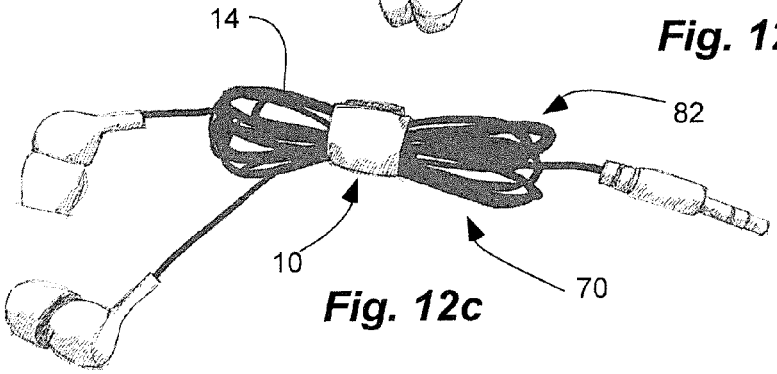

The system and audio cord can have a plurality of configuration, including: a use or free or listening configuration 74 (FIG. 8); a loop storage configuration 78 (FIGS. 10 and 11*c*); and a bundle storage configuration 82 (FIGS. 9 and 12*c*). In the use configuration 74 (FIG. 8), the audio cord 14 can extend a longer length (i.e. between the earbuds 34 in the user's ears and the audio jack 18 at the portable media player), and the ring 58 can be free of the audio cord 14, or the ring 58 can have a lesser number of passes of the audio cord 14 extending through the ring (i.e. a lesser portion of the cord can be looped or bundled in the ring or band while the user listens). In the loop storage configuration 78 (FIGS. 10 and 11*c*), the audio cord 14 can extend a shorter length (between the earbuds 34 and the audio jack 18) than the longer length, and can be wrapped into a loop 68 (FIG. 10) with a greater number of passes of the audio cord 14 extending though the ring 58 than the lesser number of passes of the use configuration, and the audio cord looping through and around the ring. In the bundle storage configuration 82 (FIGS. 9 and 12*c*), the audio cord 14 can extending a shorter length than the longer length (between the earbuds 34 and the audio jack 18) and can be wrapped into a bundle 70 (FIG. 9) with a greater number of passes of the audio cord 14 extending through the ring 58 than the lesser number of passes of the use configuration, and the audio cord extending back and forth through the ring.

Figure 13A:
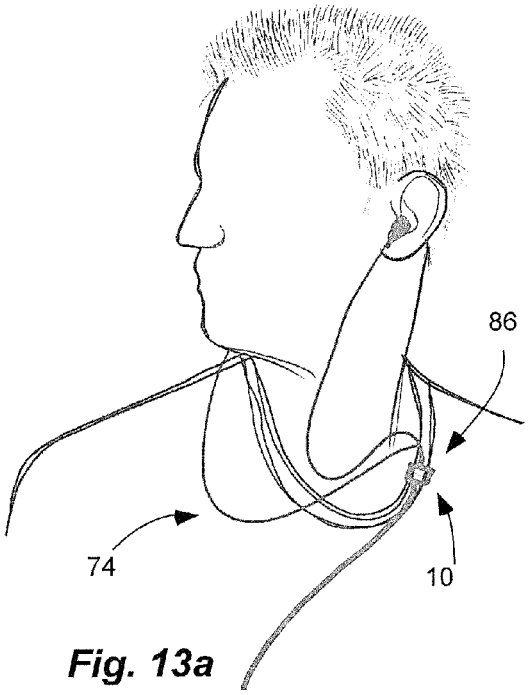
FIGS. 13*a-c* are perspective views of the methods of FIGS. 11*a*-12*c* further showing clipping the cord management system and/or band to an article of clothing by disposing the article of clothing between the distal free end of the band and the collar with the free ferromagnetic button of the distal free end of the band magnetically coupling to the fixed ferromagnetic button of the collar with the article of clothing therebetween.
Figure 13B:
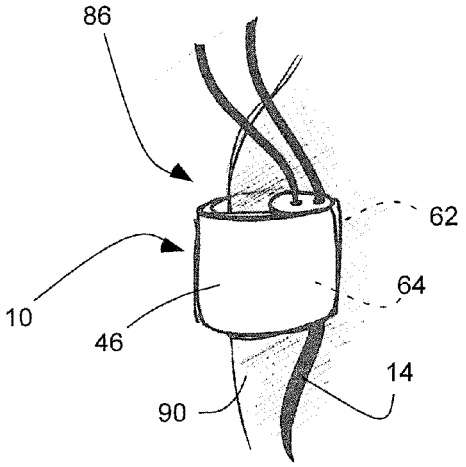
Figure 13C:
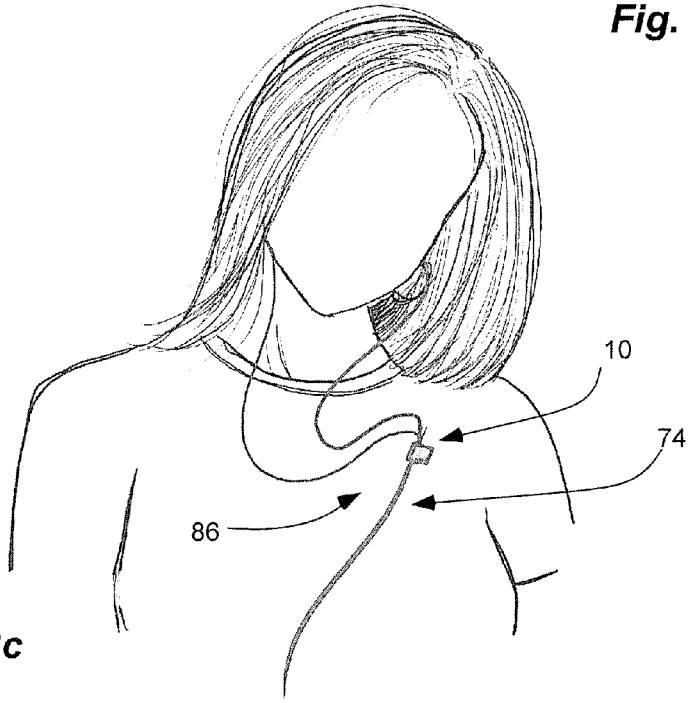

In addition, the system and audio cord can further have a clip configuration 86 (FIGS. 13*a-c*) with an article of clothing 90 with the free ferromagnetic button 62 of the distal free end 54 of the band 46 magnetically coupling to the fixed ferromagnetic button 64 of the collar 56 through the article of clothing 90. The collar 56 can be clipped to an article of clothing 90 at an edge of the clothing, such as at a seam or lapel or neckline, as shown in FIGS. 13*a* and 13*c*; or at a pinch or double up of the article of clothing, as shown in FIG. 13*b*.

In addition, the system and audio cord can further have a single earbud configuration 94 (FIGS. 14*a* and 14*b*) with a ferromagnetic element 98 of one earbud 34 of the earbuds magnetically coupled to the fixed ferromagnetic button 64 of the collar 56, or the free ferromagnetic element 63 of the band 46. In one aspect, the ferromagnetic element 98 of the earbud 34 can be a magnet of the speaker or driver in the earbud. In another aspect, the ferromagnetic element of the earbud can be a separate ferromagnetic element from the magnet of the speaker or driver in the earbud.

Furthermore, each of the pair of earbuds can have a ferromagnetic element therein so that the pair of earbuds can be magnetically coupled to each other, and/or to the collar or splitter.

Figure 15:
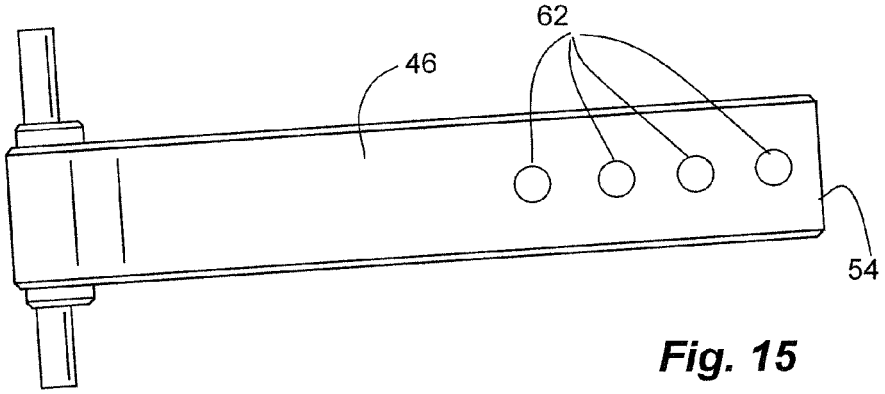
FIG. 15 is a perspective view of another cord management system in accordance with another embodiment of the invention.

In one aspect, a plurality of ferromagnetic buttons 62 can be arrayed along at least a portion of a length of the band 46 from the distal free end inwardly to form a plurality of different sized rings, as shown in FIG. 15. Thus, the size of the ring can be adjusted to accommodate more or less wraps of the audio cord.

Figure 16:
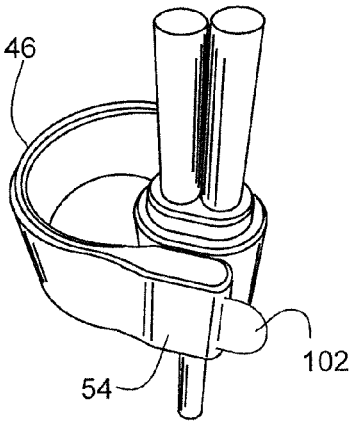
FIG. 16 is a perspective view of another cord management system is accordance with another embodiment of the present invention.

In another aspect, a tab or flap 102 can extend from the distal free end 54 of the band 46 and can be free of the free ferromagnetic buttons therein and free of the collar, as shown in FIG. 16. Thus, the tab or flap can be grasped by the user to facilitate separation of the ferromagnetic buttons.

Figure 10:
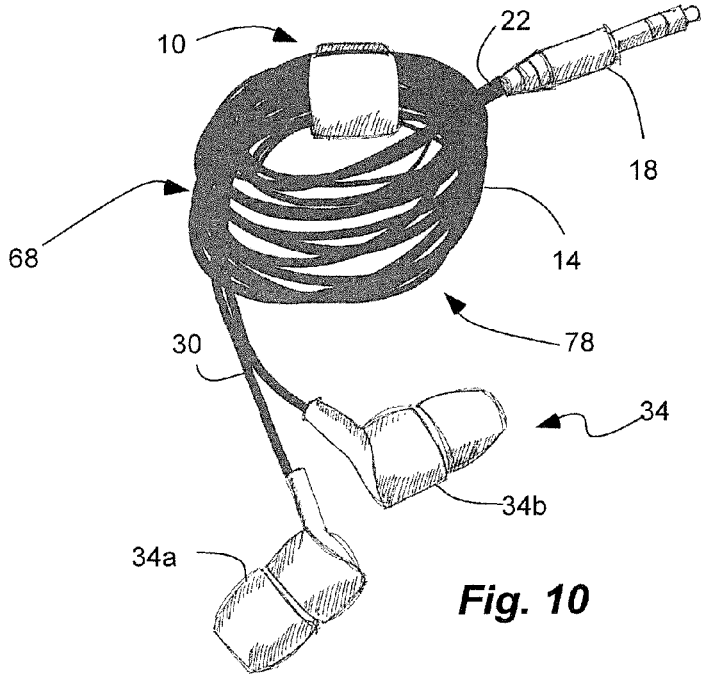
FIG. 10 is a perspective view of the cord management system of FIG. 5*a*, shown in a loop storage configuration with the audio cord extending a shorter length than the longer length and wrapped into a loop with a greater number of passes of the audio cord extending though the ring than the lesser number of passes, and with the audio cord looping through and around the ring.
Figure 11A:
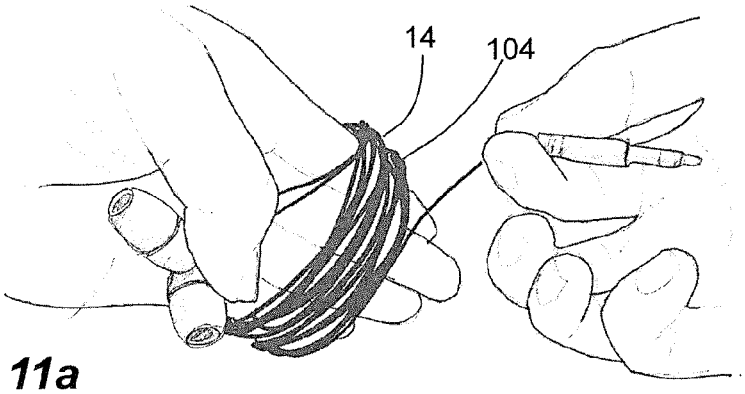
FIGS. 11*a-c* are perspective views of a method for managing an audio cord comprising an audio plug, a pair of conjoined wires extending from the audio plug and separating at a junction into a pair of wires terminating in earbuds in accordance with the present invention; with FIG. 11*a* showing forming the audio cord into a loop.
Figure 11B:
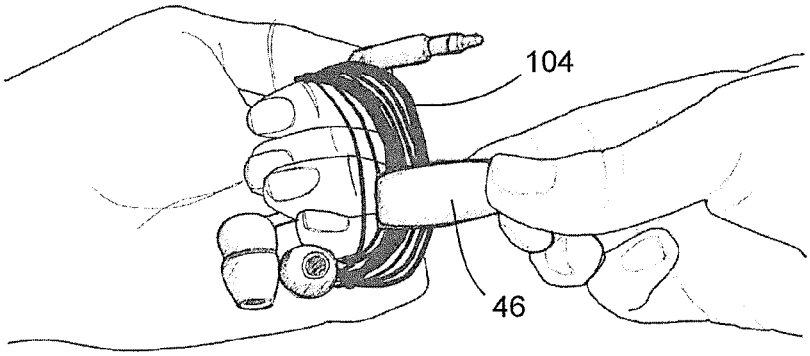
Figure 14A:
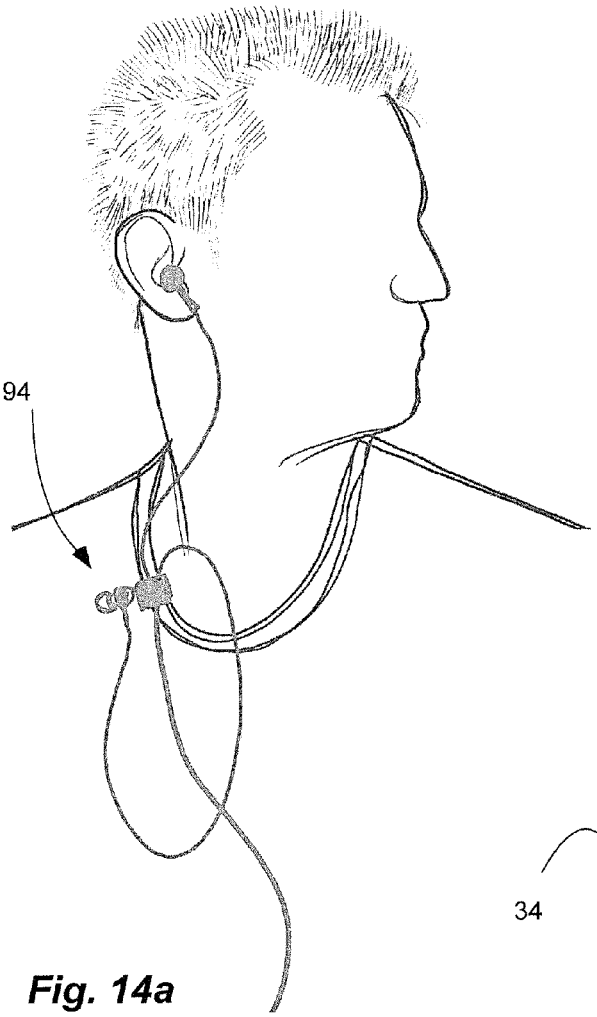
FIGS. 14*a* and *b* are perspective views of the method of FIGS. 11*a*-12*c* further showing securing an earbud of the pair of earbuds to the collar by magnetically coupling a ferromagnetic element of the earbud to the fixed ferromagnetic button of the collar.
Figure 14B:
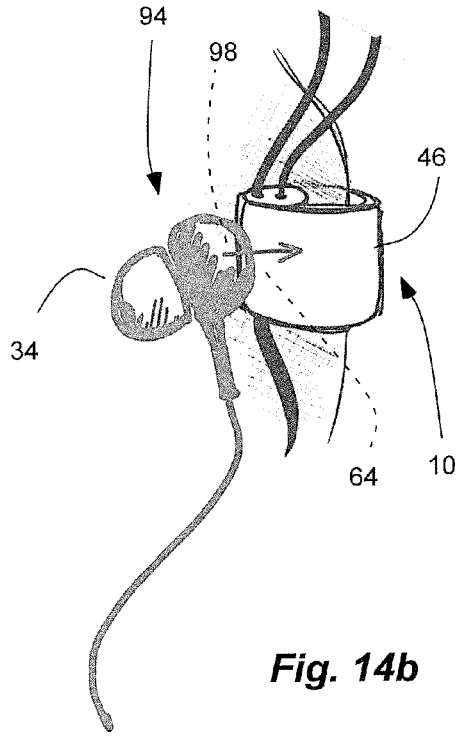

A method for managing a cord, such as an audio cord 14 comprising an audio plug 18, a pair of conjoined wires 22 extending from the audio plug 18 and separating at a junction 26 into a pair of wires 30 terminating in earbuds 34, comprises:

a) forming the audio cord 14 into a loop 104 (as shown in FIG. 11*a* such as by looping the audio cord around the fingers) or a bundle 108 (as shown in FIG. 12*a*, again such as by looping the audio cord around the fingers or wrapping the cord back and forth over itself);

b) wrapping a flexible band 46 around a portion of the loop 104 or the bundle 108 by extending a distal free end 54 through (FIG. 7*b*) or around (FIG. 8*b*) the loop or bundle and back towards a proximal end 50 extending from a collar 56 enclosing a portion of the audio cord 14 at the junction 26, the collar 56 (and/or sleeve 42) defining a splitter 38 where the audio cord separates from the conjoined wires 22 to the pair of wires 30;

c) coupling the distal free end 54 of the band 46 to the collar 56 by magnetically coupling a free ferromagnetic button 62 embedded in the distal free end 54 of the band 46 to a fixed ferromagnetic button 64 embedded in the collar 56 forming a ring 58 enclosing and securing the portion of the loop 104 or bundle 108 (forming the loop storage configuration 78 as shown in FIGS. 10 and 11*c*, or the bundle storage configuration 82 as shown in FIGS. 9 and 12*c*);

d) uncoupling the free ferromagnetic button 62 of the distal free end 54 of the band 46 from the fixed ferromagnetic button 64 of the collar 56, and removing the audio cord 14 from the ring 58 or band 46 (to form the use configuration 74 as shown in FIG. 8);

e) clipping the splitter 38 (or the flexible band 46 and the junction 26) to an article of clothing 90 by disposing the article of clothing 90 between the distal free end 54 of the band 46 and the collar 42 with the free ferromagnetic button 62 of the distal free end 54 of the band 46 magnetically coupling to the fixed ferromagnetic button 64 of the collar 56 through the article of clothing 90 (forming the clip configuration 86 as shown in FIGS. 13*a-c*);

f) securing an earbud 34 of the pair of earbuds to the collar 56 or the distal free end 54 by magnetically coupling a ferromagnetic element 98 of the earbud to the fixed ferromagnetic button 64 of the collar 42, or the free ferromagnetic button 62 of the band 54 (forming the single earbud configuration 94 as shown in FIGS. 14*a* and 14*b*).

In addition, the method can include coupling the pair of earbuds 34 together by magnetically coupling the ferromagnetic element of one earbud of the pair of earbuds to a ferromagnetic element of another earbud of the pair of earbuds.

The sleeve 42 can be taller or height than the collar 56 so that the sleeve extends beyond the collar 56 along an axis of the cord, sleeve and/or collar. In one aspect, the sleeve can be a spool and can have a pair of enlarged flanges circumscribing the collar or spool at opposite ends thereof, defining a narrower neck or annular groove therebetween. The sleeve can be rigid and can be fixed to the junction of the audio cord, defining a splitter. The collar 56, or bore thereof, can receive the narrower neck or annular groove between the pair of enlarged flanges of the spool or sleeve. The collar can be formed of a soft flexible silicone that allows the collar to flex or bend, and the bore or collar to expand to be inserted over the enlarged flange.

Although described with respect to an audio cord, the cord management system and method, and splitter or collar and band, described above can also be used with other cords, including by way of example, video cords or wires, rope, string, etc.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A cord management system in combination with an audio cord comprising an audio plug, a pair of conjoined wires extending from the audio plug and separating at a junction into a pair of separate audio wires terminating at a pair of earbuds, the system comprising:

a) a sleeve circumscribing the junction of the audio cord;

b) a flexible band extending from a proximal end at the sleeve to a distal free end;

c) the flexible band having a collar at the proximal end with a bore therethrough receiving the sleeve and the junction;

d) a free ferromagnetic button embedded in the distal free end of the band;

e) a fixed ferromagnetic button embedded in the collar at the proximal end of the band;

f) the band forming a ring with the free ferromagnetic button of the distal free end of the band magnetically coupled to the fixed ferromagnetic button of the collar for enclosing and securing a portion of a loop or a bundle formed by the audio cord;

g) the system and the audio cord having a plurality of configurations, including:

i) a use configuration with the audio cord extending a longer length, and with the ring free of the audio cord or with the ring having a lesser number of passes of the audio cord extending through the ring;

ii) a loop storage configuration with the audio cord extending a shorter length than the longer length, and wrapped into a loop with a greater number of passes of the audio cord extending though the ring than the lesser number of passes, and with the audio cord looping through and around the ring;

iii) a bundle storage configuration with the audio cord extending a shorter length than the longer length, and wrapped into a bundle with a greater number of passes of the audio cord extending through the ring than the lesser number of passes, and with the audio cord extending back and forth through the ring;

iv) a clip configuration with an article of clothing with the free ferromagnetic button of the distal free end of the band magnetically coupling to the fixed ferromagnetic button of the collar with the article of clothing therebetween; and v) a single earbud configuration with a ferromagnetic element of one earbud of the pair of earbuds magnetically coupled to the fixed ferromagnetic button of the collar, or the free ferromagnetic button of the distal free end, or both; and h) the proximal end of the band extending from one side of the collar, and the fixed ferromagnetic button being disposed in the collar on another side of the collar opposite the proximal end of the band.

2. The combination in accordance with claim 1, wherein the collar encloses a portion of the audio cord at the junction defining a splitter where the audio cord separates from the conjoined wires to the pair of wires.

3. The combination in accordance with claim 1, further comprising:

the distal free end of the band having a flat surface; and the another side of the collar opposite the proximal end of the band having a flat surface to which the flat surface of the distal free end of the band abuts.

4. The combination in accordance with claim 1, wherein the distal free end of the band is enlarged with an enlarged cross-section with respect to an intermediate portion of the band between the distal free end and the proximal end.

5. The combination in accordance with claim 1, further comprising:

a plurality of ferromagnetic buttons arrayed along at least a portion of a length of the band to form a plurality of different sized rings.

6. The combination in accordance with claim 1, further comprising:

the band being formed of flexible and resilient material and initially formed in a closed configuration with the distal free end of the band proximal the collar, and forming the ring and biased into the closed configuration and into the ring by the resiliency of the material, and having an open configuration where the distal free end of the band is separated from the collar.

7. The combination in accordance with claim 1, wherein the collar and band are integrally formed at the same time and of the same material.

8. The combination in accordance with claim 1, further comprising:

a tab or flap extending beyond the distal free end of the band and free of the free ferromagnetic buttons therein and free of the collar.

9. A method for managing the audio cord with the cord management system in accordance with claim 1, the method comprising:

a) forming the audio cord into the loop or the bundle;

b) wrapping the flexible band around a portion of the loop or the bundle by extending the distal free end through or around the loop or the bundle and back towards the collar;

c) coupling the distal free end to the collar by magnetically coupling the free ferromagnetic button embedded in the distal free end of the band to the fixed ferromagnetic button embedded in the collar, forming the ring enclosing and securing the portion of the loop or the bundle;

d) uncoupling the free ferromagnetic button of the distal free end of the band from the fixed ferromagnetic button of the collar, and removing the audio cord from the ring or the band;

e) clipping the flexible band and the junction to the article of clothing by disposing the article of clothing between the distal free end of the band and the collar with the free ferromagnetic button of the distal free end of the band magnetically coupling to the fixed ferromagnetic button of the collar with the article of clothing therebetween; and f) securing one earbud of the pair of earbuds to the collar or the distal free end by magnetically coupling a ferromagnetic element of the earbud to the fixed ferromagnetic button of the collar, or the free ferromagnetic button of the distal free end, or both.

10. The method in accordance with claim 9, further comprising:

coupling the pair of earbuds together by magnetically coupling the ferromagnetic element of one earbud of the pair of earbuds to a ferromagnetic element of another earbud of the pair of earbuds.

11. A splitter device for an audio cord, the device comprising:

a) a collar configured to be disposed at a junction of the audio cord with a pair of conjoined wires extending from an audio plug and separating at the collar into a pair of separate audio wires terminating in earbuds;

b) a band extending from a proximal end at the collar to a distal free end;

c) a free ferromagnetic button embedded in the distal free end of the band;

d) a fixed ferromagnetic button embedded in the collar;

e) the band forming a ring with the free ferromagnetic button of the distal free end of the band magnetically coupled to the fixed ferromagnetic button of the collar for enclosing and securing a portion of a loop or a bundle formed by the audio cord; and f) the proximal end of the band extending from one side of the collar, and the fixed ferromagnetic button being disposed in the collar on another side of the collar opposite the proximal end of the band.

12. The device in accordance with claim 11, further comprising:

the system and the audio cord having a plurality of configurations, including:

i) a use configuration with the audio cord extending a longer length, and with the ring free of the audio cord or with the ring having a lesser number of passes of the audio cord extending through the ring;

ii) a loop storage configuration with the audio cord extending a shorter length than the longer length, and wrapped into a loop with a greater number of passes of the audio cord extending though the ring than the lesser number of passes, and with the audio cord looping through and around the ring;

iii) a bundle storage configuration with the audio cord extending a shorter length than the longer length, and wrapped into a bundle with a greater number of passes of the audio cord extending through the ring than the lesser number of passes, and with the audio cord extending back and forth through the ring;

iv) a clip configuration with an article of clothing with the free ferromagnetic button of the distal free end of the band magnetically coupling to the fixed ferromagnetic button of the collar with the article of clothing therebetween; and v) a single earbud configuration with a ferromagnetic element of one earbud of the pair of earbuds magnetically coupled to the fixed ferromagnetic button of the collar, or the free ferromagnetic button of the distal free end, or both.

13. The device in accordance with claim 11, wherein the collar encloses a portion of the audio cord at the junction defining a splitter where the audio cord separates from the conjoined wires to the pair of wires.

14. The device in accordance with claim 11, further comprising:

the distal free end of the band having a flat surface; and the another side of the collar opposite the proximal end of the band having a flat surface to which the flat surface of the distal free end of the band abuts.

15. The device in accordance with claim 11, wherein the distal free end of the band is enlarged with an enlarged cross-section with respect to an intermediate portion of the band between the distal free end and the proximal end.

16. The device in accordance with claim 11, further comprising:

a plurality of ferromagnetic buttons arrayed along at least a portion of a length of the band to form a plurality of different sized rings.

17. The device in accordance with claim 11, further comprising:

the band being formed of flexible and resilient material and initially formed in a closed configuration with the distal free end of the band proximal the collar, and forming the ring and biased into the closed configuration and into the ring by the resiliency of the material, and having an open configuration where the distal free end of the band is separated from the collar.

18. The device in accordance with claim 11, wherein the collar and band are integrally formed at the same time and of the same material.

19. The device in accordance with claim 11, further comprising:

a tab or flap extending beyond the distal free end of the band and free of the free ferromagnetic buttons therein and free of the collar.

20. A cord management system in combination with a cord, the system comprising:

a) a collar with a bore enclosing a portion of the cord;

b) a flexible band extending, from a proximal end at the collar to a distal free end;

c) a free ferromagnetic button embedded in the distal free end of the band;

d) a fixed ferromagnetic button embedded in the collar;

e) the band forming a ring with the free ferromagnetic button of the distal free end of the band magnetically coupled to the fixed ferromagnetic button of the collar for enclosing and securing a portion of a loop or a bundle formed by the cord; and wherein the collar encloses a portion of an audio cord at the junction defining a splitter terminating at a pair of earbuds.

21. The system in accordance with claim 20, further comprising:

the proximal end of the band extending from one side of the collar, and the fixed ferromagnetic button being disposed in the collar on another side of the collar opposite the proximal end of the band.

22. The system in accordance with claim 21, further comprising:

the distal free end of the band having a flat surface; and the another side of the collar opposite the proximal end of the band having a flat surface to which the flat surface of the distal free end of the band abuts.

23. The system in accordance with claim 20, further comprising:

the system having a plurality of configurations, including:

i) a use configuration with the cord extending a longer length, and the ring free of the cord or the ring having a lesser number of passes of the cord extending through the ring;

ii) a loop storage configuration with the cord extending a shorter length than the longer length, and wrapped into a loop with a greater number of passes of the cord extending though the ring than the lesser number of passes, and the cord looping through and around the ring; and iii) a bundle storage configuration with the cord extending a shorter length than the longer length, and wrapped into a bundle with a greater number of passes of the cord extending through the ring than the lesser number of passes, and the cord extending back and forth through the ring.

* * * * *